US005090323A

United States Patent [19]

Kallevig et al.

[11] Patent Number: 5,090,323

[45] Date of Patent: Feb. 25, 1992

[54] TWO-PIECE AMMUNITION PROPELLANT CONTAINMENT BAG

[75] Inventors: John A. Kallevig, St. Paul; James L. Kennedy, Bloomington, both of Minn.

[73] Assignee: 501 Alliant Techsytems Inc., Edina, Minn.

[21] Appl. No.: 606,766

[22] Filed: Oct. 31, 1990

[51] Int. Cl.[5] ..... F42B 5/02; F42B 5/16

[52] U.S. Cl. ..... 102/282; 102/430; 102/431; 102/464; 102/521

[58] Field of Search ..... 102/282, 430, 431, 439, 102/520, 521, 464, 465, 466, 700

[56] References Cited

U.S. PATENT DOCUMENTS

| | | | |
|---|---|---|---|
| 3,034,433 | 5/1962 | Gronn | 102/464 |
| 3,125,957 | 3/1964 | Lipinski | 102/430 |
| 3,397,637 | 8/1968 | Bobinski et al. | 102/431 |
| 3,830,157 | 8/1974 | Dunnard et al. | 102/464 |
| 3,832,951 | 9/1974 | Katz et al. | 102/439 |
| 3,981,246 | 9/1976 | Luther et al. | 102/521 |
| 4,187,271 | 2/1980 | Rolston et al. | 102/466 |

*Primary Examiner*—David H. Brown
*Attorney, Agent, or Firm*—Whitham & Marhoefer

[57] ABSTRACT

A containment bag has two sections. A forward section with one end secured positively in the sabot-obturator interface region during the assembly of the sabot, obturator, projectile and casing adapter. The other end of the forward section has a circumferential securing band, for example a band of loops of the type marketed under the trademark Velcro. An aft bag section is secured to the cartridge casing at one end in a conventional manner and the other end has a circumferential securing band; Velcro hooks for example. The bands join the two sections of the bag together when the cartridge casing is brought into position to be bonded to the cartridge adapter.

8 Claims, 3 Drawing Sheets

TWO-PIECE AMMUNITION PROPELLANT CONTAINMENT BAG

BACKGROUND OF THE INVENTION

1. Field of the Invention

The present invention generally relates to containment bags for ammunition propellants, and more particularly to an improved two-piece bag which facilitates the process of manufacturing the ammunition and increases the utilizable propellant volume as compared to prior art containment bags.

2. Description of the Prior Art

Propellant containment bags are used in combination with combustible cartridge cases in order to prevent the leakage of propellant in the event of a rupture in the cartridge case. The bottom of the containment bag, which is made of rayon for example, is secured at the rear of the cartridge case. The top of the bag is open so that it fits over the projectile boom and sabot. In the prior art assembly process, the cartridge case with the containment bag attached is aligned with the assembled sabot, cartridge adapter, obturator, and projectile. The open end of the containment bag is slipped over the rear portion of the sabot and is secured to the sabot by means of a cord. The cartridge case is then abutted to a cartridge adapter and adhesively secured thereto.

This prior art design has two principal limitations. The volume of propellant the bag can hold is less than its total volume because the bag cannot be tied to the sabot at the most forward position. Thus, there is a fold in the bag so it contacts not only the inside wall of the cartridge adapter but also a portion of the sabot and projectile boom. In addition, the prior art design is susceptible to bunching in this forward section.

SUMMARY OF THE INVENTION

An object of this invention is the provision of an improved containment bag in which the end of the bag is secured in a most forward position, i.e., in the region of the sabot-obturator interface. A bag which is easily installed in the assembly operation; and a bag which allows substantially the entire cartridge and cartridge adapter volume to be filled with propellant.

Briefly, this invention contemplates the provision of a containment bag which has two sections. A forward section with one end secured positively in the sabot-obturator interface region during the assembly of the sabot, obturator, projectile and casing adapter. The other end of the forward section has a circumferential securing band, for example a band of loops of the type marketed under the trademark Velcro. An aft bag section is secured to the cartridge casing at one end in a conventional manner and the other end has a circumferential securing band; Velcro hooks for example. The bands join the two sections of the bag together when the cartridge casing is brought into position to be bonded to the cartridge adapter.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
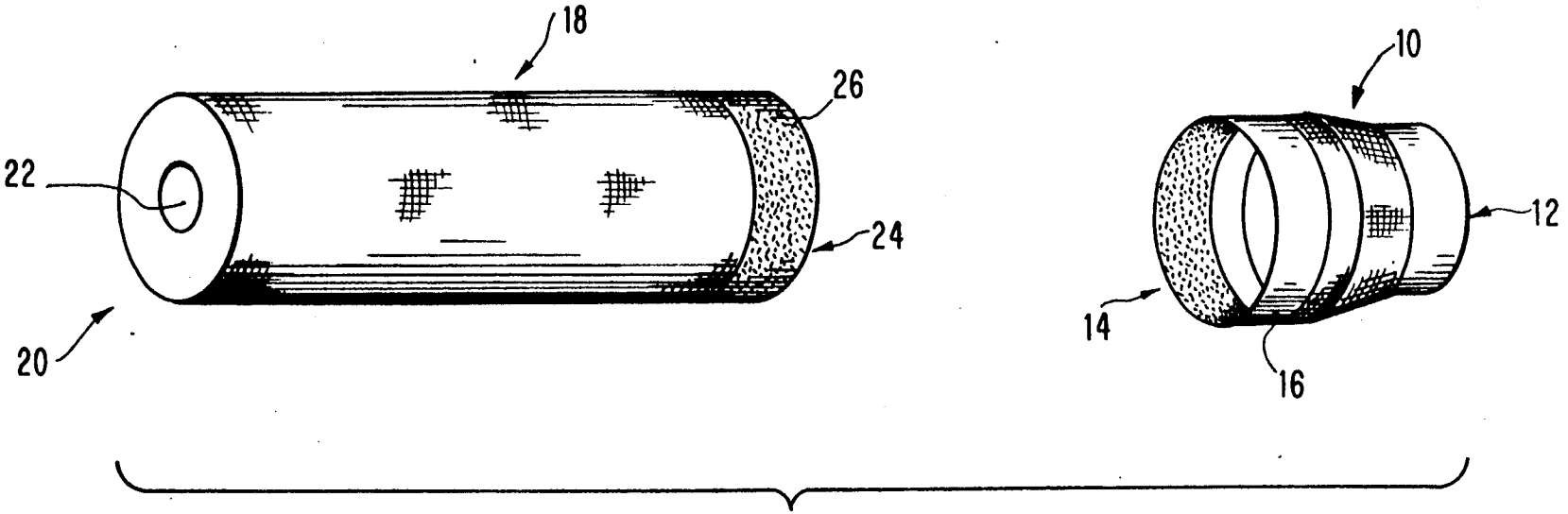
FIG. 1 is a perspective view of one embodiment of a two-piece containment bag in accordance with the teaching of this invention.

Referring now to FIG. 1 of the drawings, the forward section 10 of the containment bag is generally frostro-conical in shape to match generally the shape of the cartridge case adapter. It may be made of the same material as conventional propellant containment bags, for example, rayon. One end 12 is secured in the sabot-obturator interface region as will be described in more detail in connection with FIGS. 2 and 3. The other end 14 of the forward section carries band 16 adapted to join this forward section to an aft section of the bag. In this preferred embodiment of the invention, the band 16 is a band of hook material of the type sold under the trademark Velcro. The hooks are on the inner surface of the band and the band may be secured to the forward section of the bag by thread stitches sewn by machine in a conventional manner.

The aft section 18 of the containment bag is generally cylindrical in shape and is adapted to be secured at its aft end 20 to the cartridge casing in the same manner as conventional prior art propellant containment bags. As in a conventional containment bag, the aft end of the bag has an opening 22 through which the propellant particles are poured into the bag after the cartridge has been secured to the cartridge casing adapter. The other end 24 of the aft section of the containment bag has a circumferential band of Velcro loop material 26 with the hooks on the outer surface of the band. The band 26 may be sewn onto the containment bag, which bag may be made of a conventional material such as rayon.

Figure 2:
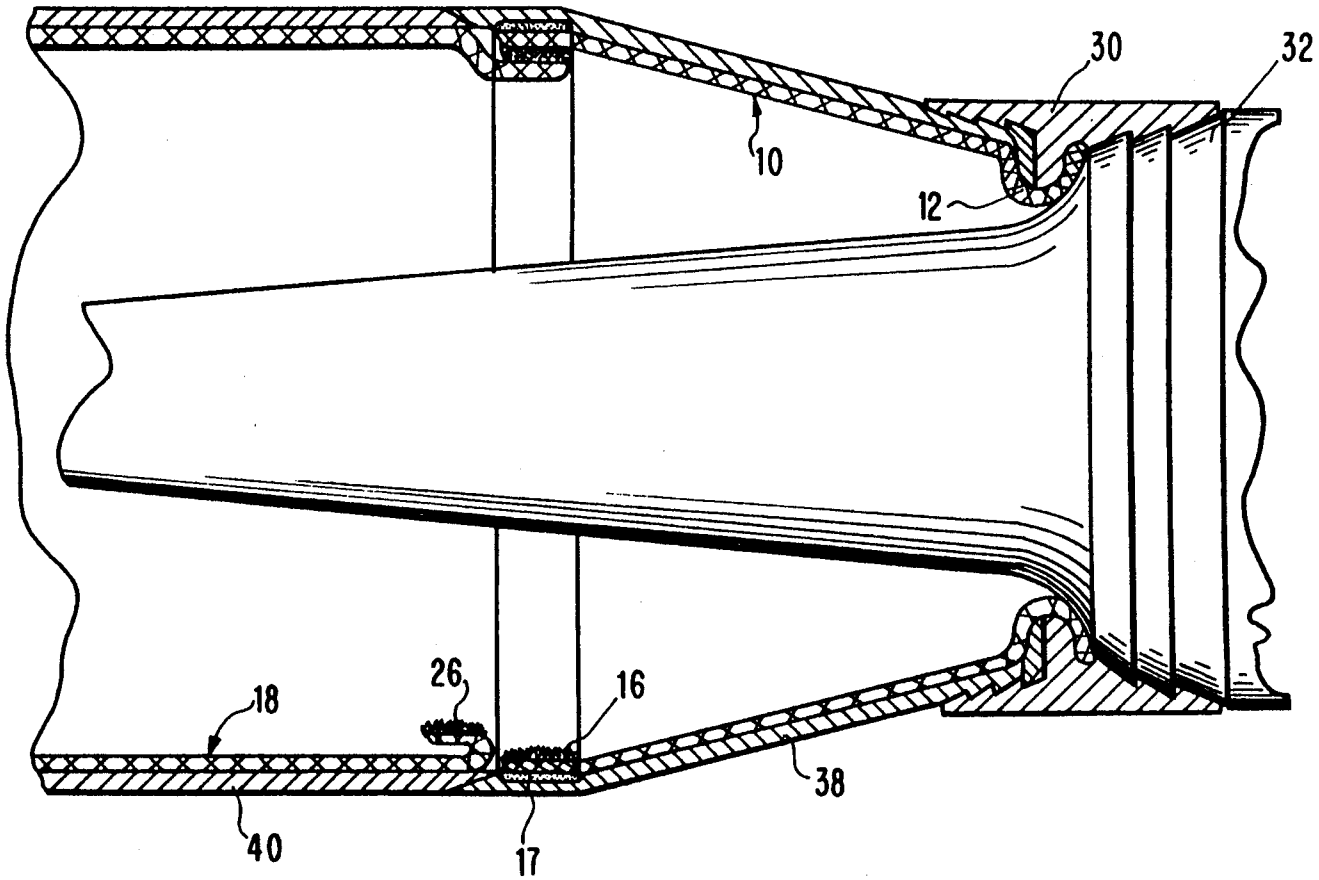
FIG. 2 is fragmentary, detailed views of embodiments of the invention showing a preferred means to secure the forward section of the containment bag in the sabot-obturator interface.

Referring now to FIG. 2, an obturator 30 (shown in section) is secured to a sabot 32 (shown partially) at the forward end of the propellant compartment. The end 12 of the forward section of the bag 10 is inserted between the obturator 30 and the sabot 32 during assembly of the obturator and sabot, and is clamped tight between them when the obturator is secured to the sabot. The outer surface of the other end 14 of the forward section 10 of the bag is secured to the inner surface of a casing adapter 38 by means of a suitable adhesive 17 (shown exaggerated) after the casing adaptor has been secured to the obturator, as shown. As shown in the drawing, the inner surface of the adapter and the forward section of the bag are preferably co-extensive.

As mentioned previously, one end 20 of the aft bag section 18 is secured to the bottom 41 (shown in FIG. 3) of a cartridge casing 40 by a conventional means such as a spring disk clamp. Referring back to FIG. 1, the other end 24, which carries the Velcro band 26, preferably extends beyond the end of the casing by the width of the band. In assembly, the cartridge casing is brought into position so that its edge abuts the edge of the casing adapter, the band 26 may be folded inwardly, as shown in the lower portion of FIG. 2. After the casing 40 has been adhesively bonded to the casing adapter 38, a rod may be inserted through the fill hole 20 in aft bag section to unfurl the band so that the loops on the outer surface of the band 26 engage the hooks on the inner surface of the band 16, thereby securing together the two sections of the propellant containment bag, as shown in the upper section of FIG. 2. As the bag is filled with propellant, the outward pressure exerted by the propellant particles urges the interlocked surfaces into complete engagement with one another.

Figure 3:
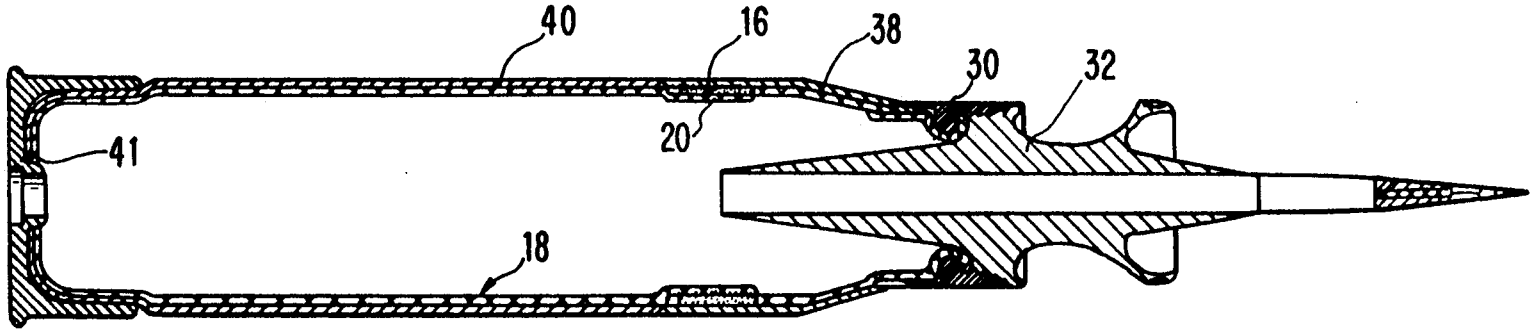
FIG. 3 is a sectional view of an assembled round with the two sections of the bag joined.

FIG. 3 shows, in section, an assembled round with a two-piece containment bag in accordance with the teachings of this invention.

While the invention has been described in terms of a single preferred embodiment, those skilled in the art will recognize that the invention can be practiced with modification within the spirit and scope of the appended claims.

Having thus described our invention, what we claim as new and desire to secure by Letters Patent is as follows:

1. A round of ammunition comprising in combination;

a forward propellant bag section;

a sabot, an obturator, one end of said forward propellant bag section, and a cartridge casing adapter secured together to form an assembly;

means to secure the other end of said forward propellant bag section to the inner surface of said cartridge casing adapter;

an aft propellant bag section;

a cartridge casing;

means to secure one end of said aft propellant bag section to one end of said cartridge casing;

respective other ends of said forward and aft propellant bag sections overlapping when said cartridge casing is joined to said cartridge casing adapter; and means carried by said respective other ends of said forward and aft containment bag sections for joining together said sections.

2. A round of ammunition as in claim 1 wherein said means to secure secures said one end of said forward propellant bag section to said assembly in a region where said sabot and said obturator are joined.

3. A round of ammunition as in claim 1 wherein the other end of said aft propellant bag extends beyond the other end of said cartridge casing so as to form said overlapping bag sections.

4. A round of ammunition as in claim 1 wherein said joining means comprises a circumferential band of hook material secured to one of said other ends which frictional engages a circumferential band of loop material secured to the other of said other ends.

5. A round of ammunition as in claim 4 wherein said means to secure secures said one end of said forward propellant bag section to said assembly in a region where said sabot and said obturator are joined.

6. A round of ammunition as in claim 5 wherein the other end of said aft propellant bag extends beyond the other end of said cartridge casing so as to form said overlapping bag sections.

7. A round of ammunition comprising in combination;

a sabot, an obturator, and a cartridge casing adapter secured together to form an assembly;

a propellant bag; and one end of said propellant bag clamped between said obturator and said sabot in order to secure said bag to said assembly.

8. A round of ammunition comprising in combination;

a forward propellant bag section;

a sabot, an obturator, one end of said forward propellant bag section and a cartridge casing adapter secured together to form an assembly;

means to secure the other end of said forward propellant bag section to the inner surface of said cartridge casing adapter;

an aft propellant bag section;

a cartridge casing means to secure one end of said aft propellant bag section to one end of said cartridge casing;

respective other ends of said forward and aft propellant bag sections overlapping when said cartridge casing is joined to said cartridge casing adapter; and means carried by said respective other ends of said forward and aft containment bag sections for joining together said sections in response to pressure exerted by propellant filling said bag sections.

* * * * *